United States Patent [19]

Moore

[11] Patent Number: 4,568,257

[45] Date of Patent: Feb. 4, 1986

[54] ROTARY PUMP

[76] Inventor: Jesse C. Moore, 309 S. Portland St., Celina, Ohio 45822

[21] Appl. No.: 600,281

[22] Filed: Apr. 13, 1984

[51] Int. Cl.[4] ..... F04C 2/00

[52] U.S. Cl. ..... 418/173; 418/184; 418/185; 418/187

[58] Field of Search ..... 418/173, 184, 185, 187, 418/186

[56] References Cited

U.S. PATENT DOCUMENTS

| | | | |
|---|---|---|---|
| 983,754 | 2/1911 | Nichols | 418/184 |
| 1,719,954 | 7/1929 | Wilson | 418/185 X |
| 1,941,651 | 1/1934 | Behlmer | 418/185 |
| 3,298,331 | 1/1967 | Butler | 418/187 X |

*Primary Examiner*—Leonard E. Smith
*Attorney, Agent, or Firm*—Jacox & Meckstroth

[57] ABSTRACT

A rotary vane pump comprising an inner rotor and an outer rotor which rotate about eccentric axes. A pair of hollow support shafts rotatably support the inner rotor and serve as passages for flow of fluid to and from the inner rotor. Passages within the inner rotor are in fluid communication with the passages which extend through the support shafts. The relative dimensions of the inner rotor and outer rotor are such that a chamber is formed between the inner rotor and outer rotor. A vane is attached to the outer rotor and slidably extends into a slot in the inner rotor. The vane divides the chamber into intake and outlet portions. A check-valve is positioned to control flow of fluid in the outlet portion of the inner rotor.

6 Claims, 14 Drawing Figures

134
54
104
112
3
38
52
24
20
32
30
28
130
100
106
110
114
118
120
124
75
74
94
66
62
60
70
61
64
76
14
88
82
86
80
90
78
44
40
102

ROTARY PUMP

BACKGROUND OF THE INVENTION

Numerous rotary vane pumps have been devised for pumping fluids. However, most of the known rotary vane pumps have been found to be relatively inefficient in operation and complex in structure. Known rotary vane pumps also are subject to excessive wear of the moving parts. Known rotary vane pumps do not have good seal characteristics between moving parts.

It is therefore an object of this invention to provide a rotary vane pump which is efficient in operation, and which does not have parts which wear excessively.

It is another object of this invention to provide such a rotary vane pump in which "back-flow" does not occur.

Another object of this invention is to provide such a rotary vane pump in which the bearings are readily accessible for inspection.

It is another object of this invention to provide such a rotary vane pump which can be produced and operated at relatively low costs.

Other objects and advantages of this invention reside in the construction of parts, the combination thereof, the method of production and the mode of operation, as will become more apparent from the following description.

SUMMARY OF THE INVENTION

This invention comprises rotary pump for pumping fluids, hydraulic or gas. The rotary pump comprises an inner rotor and an outer rotor which rotate together about eccentric axes. The outer rotor comprises a cylindrical enclosure within which the inner rotor is positioned. A vane is attached to the inner surface of the outer rotor and slidably extends into a slot in the inner rotor. Due to the fact that the inner rotor and the outer rotor rotate about eccentric axes, there is relative reciprocal lateral movement between the inner rotor and the vane which is attached to the outer rotor during rotation thereof.

The inner rotor is supported by rotary tubular shafts through which fluid flows into and out of the pump.

DETAILED DESCRIPTION OF THE PREFERRED EMBODIMENT

Figures 1, 2:
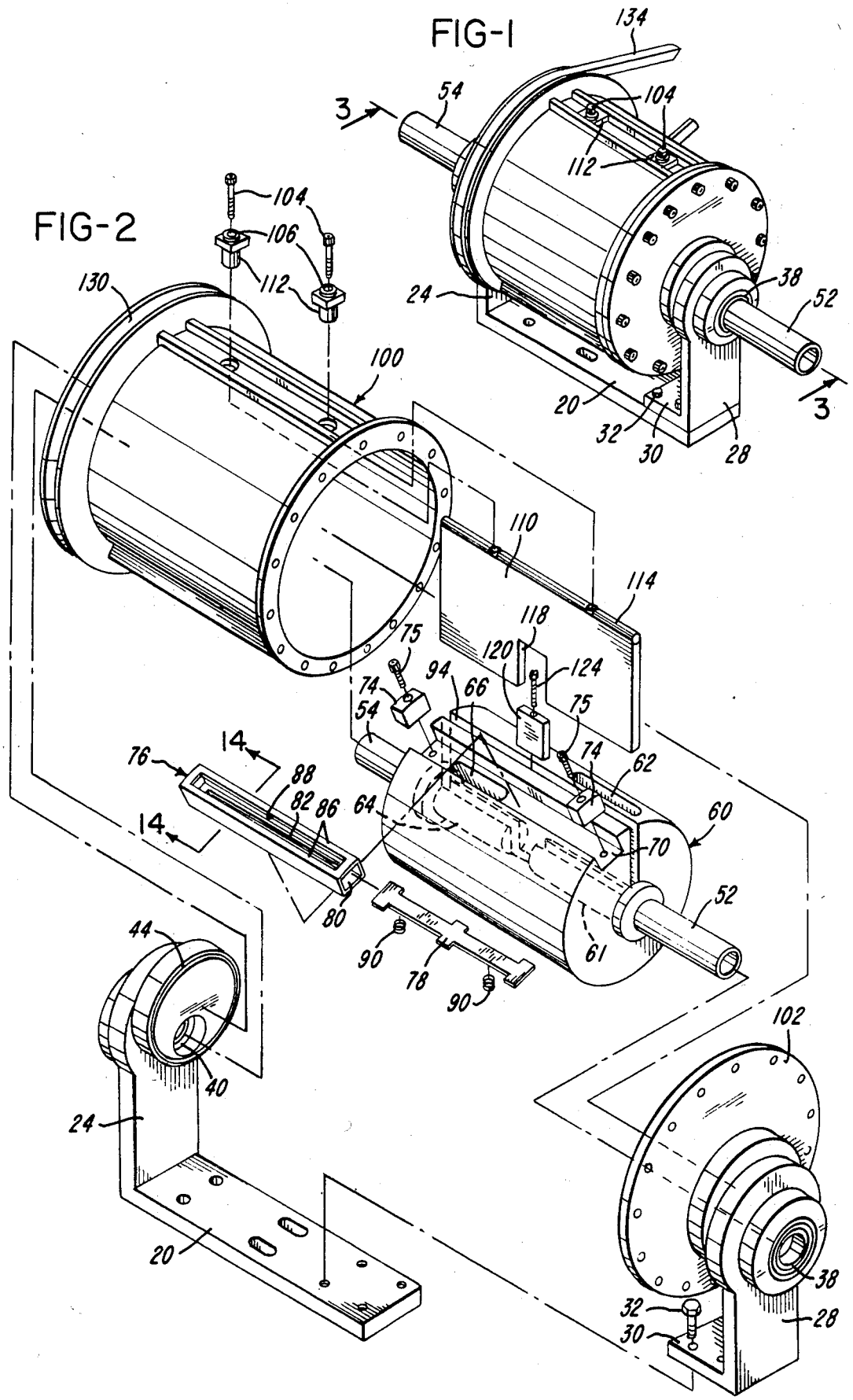
FIG. 1 is a perspective view of a rotary pump of this invention.
FIG. 2 is an exploded perspective view of the rotary pump, drawn on a larger scale than FIG. 1.
Figure 3:
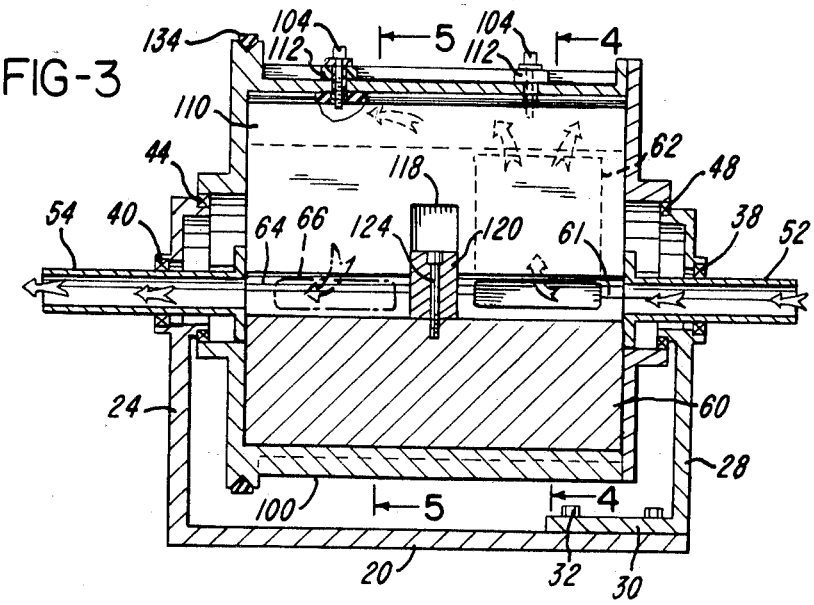
FIG. 3 is a sectional view taken substantially on line 3—3 of FIG. 1 and drawn on a larger scale than FIG. 1.
Figure 4:
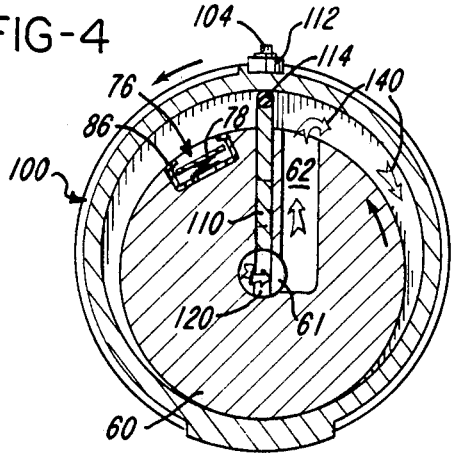
FIG. 4 is a sectional view taken substantially on line 4—4 of FIG. 3.

A rotary vane pump of this invention comprises a base 20, shown herein as being horizontal. The base 20 has a pedestal 24 at one end thereof and a pedestal 28 at the other end thereof. The pedestal 28 is shown as being attached to the base 20 by means of a plate 30 and bolts 32.

The pedestal 28 supports a bearing 38, and the pedestal 24 supports a bearing 40. The pedestal 24 also supports a bearing 44, and the pedestal 28 also supports a bearing 48. The bearings 38 and 40 are coaxial and the bearings 44 and 48 are coaxial. However, the bearings 44 and 48 are not coaxial with the bearings 38 and 40. A hollow shaft 52 extends through the bearing 38 and is rotatably supported thereby. A hollow shaft 54 extends through the bearing 40 and is rotatably supported thereby. The hollow shafts 52 and 54 are attached to an inner rotor 60 and support the inner rotor 60. The inner rotor 60 has an axially extending passage 61 which is in communication with the passage through the hollow shaft 52. The inner rotor 60 also has a radially extending passage 62 which is in communication with the axial extending passage 61. The passage 62 terminates at the periphery of the inner rotor 60. The inner rotor 60 also has an axial passage 64 which is in communication with the passage through the hollow shaft 54 and a radially extending passage 66 which is in communication with the axially extending passage 64. The radially extending passage 66 terminates within an axially extending channel 70, in the peripheral surface of the inner rotor 60. The channel 70 is positioned in the periphery of the inner rotor 60 and extends substantially the length thereof. Blocks 74 are positioned in opposite ends of the channel 70, to partially enclose the channel 70, and are shown attached to the inner rotor 60 by bolts 75.

Firmly positioned within the channel 70 and between the blocks 74 is an elongate valve housing 76 within which is an elongate valve 78. The valve housing 76 has a floor 80 provided with a passage 82 therethrough. The passage 82 is in communication with the passage 66 in the inner rotor 60. The valve housing 76 also has a wall 86, which is opposite the floor 80 and which has a passage 88 which is shown extending substantially the length of the valve housing 76. A plurality of springs 90 are seated upon the floor 80 and engage the valve 78 and urge the valve 78 toward the wall 86. The valve 78 is normally in engagement with the wall 86.

The inner rotor 60 has a radially extending slot 94 which extends the length thereof.

Encompassing the rotor 60 is an outer rotor 100 which is rotatably supported by the bearings 44 and 48. An end cover 102 forms one end of the outer rotor 100 and joins the outer rotor 100 to the bearing 48. As shown in FIGS. 3–11, the diameter of the inner rotor 60 is considerably less than the inside diameter of outer rotor 100.

Extending into the outer rotor 100 are a plurality of bolts 104, each of which is encompassed by axially aligned sleeves 106 and 108. The bolts 104 are attached to an elongate vane 110 which is positioned within the elongate slot 94 of the inner rotor 60. Each of the bolts 104 is seated upon and extends through an elastomeric pad 112. Each bolt 104 and its respective sleeve 108 extends through an elastomeric seal member 114 which extends the length of the vane 110. The slot 94 is shown as being in communication with the passages 61 and 64, in order to permit maximum movement between the vane 110 and the inner rotor 60 as the rotors 60 and 100 rotate. In such event, the vane 110 has a notch 118 therein at the inner central portion thereof. A barrier 102 is positioned within the notch 118 and within the slot 94 and is attached to the inner rotor 60 by means of a bolt 124. However, for a relatively short stroke vane it is not necessary to have fluid communication between the slot 94 and the passages 61 and 64. In such event, the notch 118 and the barrier 120 may not be necessary.

Encompassing the outer rotor 100 at one end thereof is a belt groove 130. A drive belt 134 is shown within the belt groove 130 for rotation of the outer rotor 100 and the inner rotor 60. As illustrated in FIGS. 4–11, the rotors 60 and 100 are rotated in a counter-clockwise direction.

OPERATION

The drive belt 134 is in operative relationship with any suitable rotary power mechanism for rotating the outer rotor 100. Due to the fact that the vane 110 is attached to the outer rotor 100 and extends into the slot 94 of the inner rotor 60, the inner rotor 60 rotates with rotation of the outer rotor 100. However, due to the fact that the inner rotor 60 has a smaller diameter than the inside diameter of the outer rotor 100 and due to the fact that the outer rotor 100 and the inner rotor 60 rotate about eccentric axes, there is relative lateral movement between the inner rotor 60 and the vane 110 which is attached to the outer rotor 100 during rotation thereof.

Figure 6:
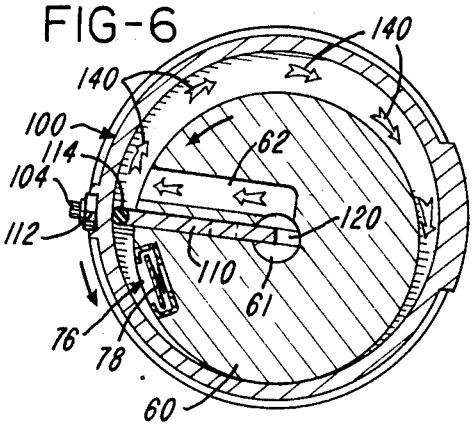
FIG. 6 is a sectional view taken substantially on line 4—4 of FIG. 3 but illustrating the elements of the rotary pump in another position of operation.
Figure 8:
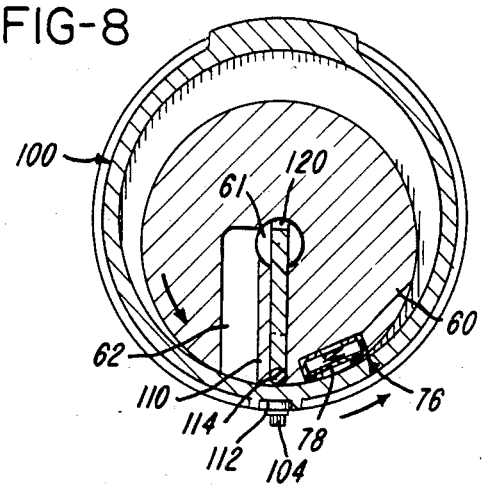
FIG. 8 is a sectional view taken substantially on line 4—4 of FIG. 3 but illustrating the elements in still another position of operation.
Figure 9:
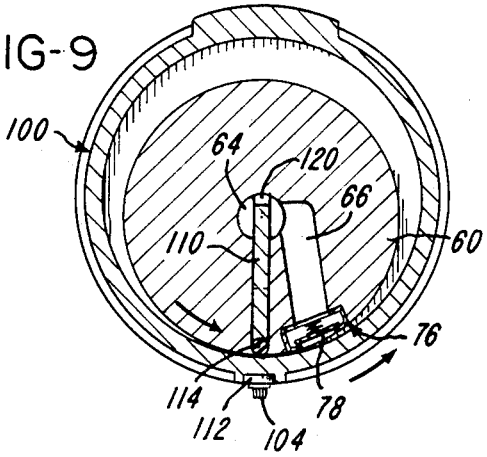
FIG. 9 is a sectional view taken substantially on line 5—5 of FIG. 3 but illustrating the elements in still another position of operation.

As the rotors 60 and 100 are rotated by operation of the drive belt 134, fluid flows into the inner rotor 60 through the hollow shaft 52, through the axially extending passage 61, and through the radially extending passage 62. The fluid then flows into a chamber which exists between the inner rotor 60 and the outer rotor 100. The chamber is divided into two portions by the vane 110. As illustrated by arrows 140 in FIG. 4, the fluid flows into the portion of the chamber which trails the vane 110. As the rotors 60 and 100 continue to rotate as illustrated in FIG. 6, the portion of the chamber which trails the vane 110 increases in volumetric capacity, and more fluid flows into the portion of the chamber which trails the vane 110. As the rotors 60 and 100 continue to rotate, a position is reached, as shown in FIGS. 8 and 9, in which there is only one chamber between the outer rotor 100 and the inner rotor 60. At this position the chamber is at maximum volumetric capacity, and no additional fluid flows thereinto.

Figure 5:
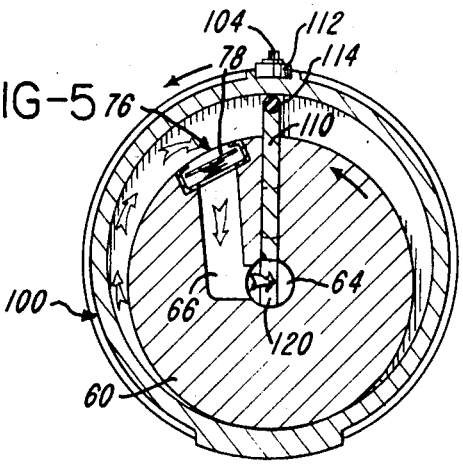
FIG. 5 is a sectional view taken substantially on line 5—5 of FIG. 3.
Figure 7:
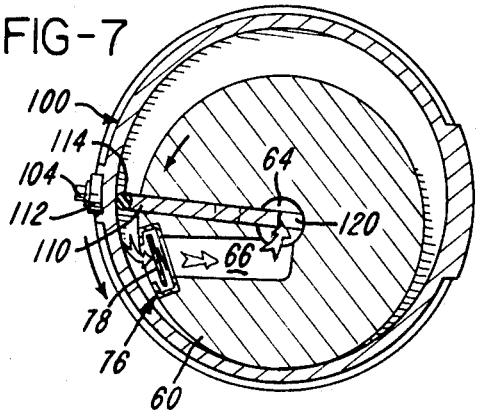
FIG. 7 is a sectional view taken substantially on line 5—5 of FIG. 3 but illustrating the elements of the rotary pump in another position of operation.
Figure 10:
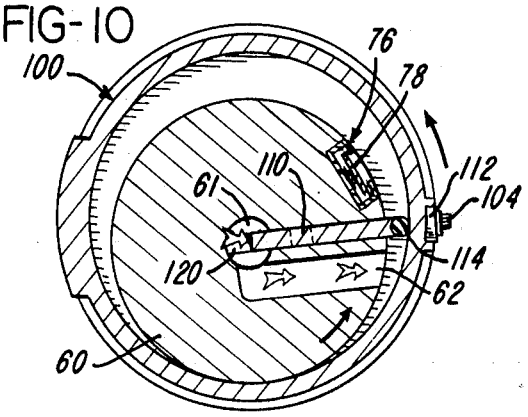
FIG. 10 is a sectional view taken substantially on line 4—4 of FIG. 3 but illustrating the elements in still another position of operation.
Figure 11:
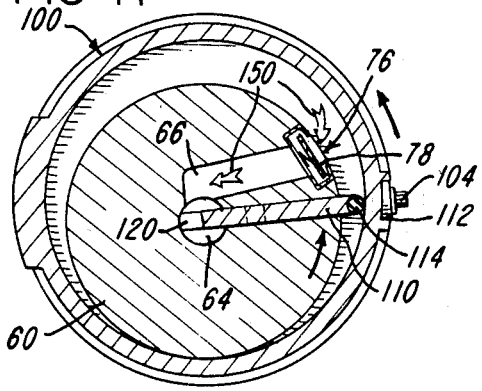
FIG. 11 is a sectional view taken substantially on line 5—5 of FIG. 3 and illustrating the elements in still another position of operation.

As the rotors 60 and 100 continue to rotate from the positions thereof shown in FIGS. 8 and 9 to the positions thereof shown in FIGS. 10 and 11, the portion of the chamber into which fluid has flowed in the manner described above is in a location which leads the vane 110. Therefore, as the rotors 60 and 100 continue to rotate to the positions thereof shown in FIGS. 10 and 11 the portion of the chamber which leads the vane 110 decreases in volumetric capacity and the fluid is forced therefrom, as illustrated by arrows 150 in FIG. 11. As the rotors 60 and 100 continue to rotate, as shown in FIGS. 11, 5, and 7, the fluid forces the valve 78 to move from the wall 86 of the valve housing 76, and fluid flows through the valve housing 76 into the radially extending passage 66. The fluid flows through the passage 66 into the axially extending passage 64. The fluid then flows outwardly from the passage 64 and then through the passage in the hollow shaft 54.

Figure 12:
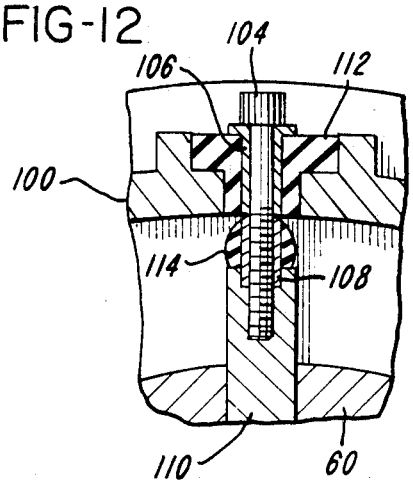
FIG. 12 is an enlarged fragmentary sectional view illustrating the mutual attachment of certain elements of the rotary pump.
Figure 13:
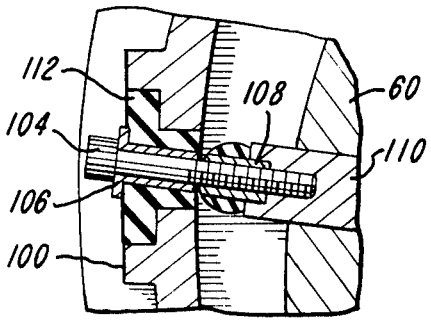
FIG. 13 is an enlarged fragmentary sectional view similar to FIG. 12 but showing the elements in a different position of operation.
Figure 14:
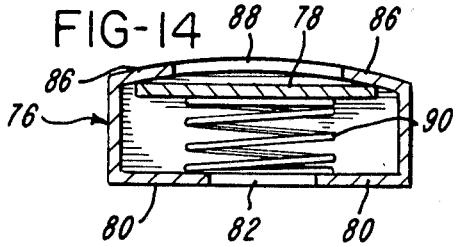
FIG. 14 is an enlarged sectional view taken substantially on line 14—14 of FIG. 2, showing the valve housing and valve of a fluid pump of this invention.

Thus, it is understood that as the rotors 60 and 100 of the fluid pump of this invention are rotated, fluid flows into the fluid pump through the hollow shaft 52 and outwardly through the hollow shaft 54. During rotation of the rotors 60 and 100, there is relative radial or transverse movement between the inner rotor 60 and the outer rotor 100 and between the inner rotor 60 and the vane 110, as sliding action occurs between the vane 110 and the inner rotor 60. A chamber is formed between the inner rotor 60 and the outer rotor 100. The barrier 120 prevents axial flow of fluid through the slot 94, as the vane 110 and the inner rotor 60 move relatively radially. The attachment of the vane 110 to the outer rotor by means of the elastomeric pads 112 and the elastomeric seal member 114 permits the vane 110 to move angularly during rotation of the rotors 60 and 100, as illustrated in FIGS. 12 and 13.

The valve 78 serves as a check valve and ensures unidirectional fluid flow through the radially extending passage 66. Thus, back-flow of fluid is prevented.

Although the preferred embodiment of the rotary pump of this invention has been described, it will be understood that within the purview of this invention various changes may be made in the form, details, proportion and arrangement of parts, the combination thereof, and the mode of operation, which generally stated consist in a structure within the scope of the appended claims.

The invention having thus been described, the following is claimed:

1. A fluid pump comprising:

support means, an inner rotor, the inner rotor having an interior and an exterior, structure means rotatably joining the inner rotor to the support means, an outer rotor, the outer rotor having an inner dimension considerably larger than the inner rotor to form a chamber between the outer rotor and the inner rotor, means rotatably attaching the outer rotor to the support means for rotation about an axis spaced from the axis of rotation of the inner rotor, means forming a first passage within the inner rotor and extending between the interior thereof and the exterior thereof, means forming a second passage within the inner rotor and extending between the interior thereof and the exterior thereof, the structure means including fluid conduit means in communication with the first passage for flow of fluid into the inner rotor and into the chamber between the inner rotor and the outer rotor, the structure means also including fluid conduit means in communication with the second passage for flow of fluid from the chamber between the inner rotor and the outer rotor and outwardly from the inner rotor and the outer rotor and outwardly from the inner rotor, an axially extending vane attached to the outer rotor and slidably extending into the inner rotor, means forming a longitudinally extending slot in the inner rotor within the vane is slidable, the slot being in communication with the first passage and the second passage, and barrier means within the slot and preventing flow of fluid through the slot.

2. A fluid pump comprising:

an inner rotor, an outer rotor encompassing the inner rotor, means rotatably supporting the outer rotor, a first hollow shaft having a passage therethrough and a second hollow shaft having a passage therethrough, the hollow shafts being attached to the inner rotor for rotation therewith and supporting the inner rotor for rotation about an axis eccentric with respect to the axis of rotation of the outer rotor, means forming a first passage within the inner rotor and terminating at the periphery thereof, the first passage means being in communication with the passage through the first hollow shaft, means forming a second passage within the inner rotor and terminating at the periphery thereof, the second passage being in communication with the passage through the second hollow shaft, a vane attached to the outer rotor and slidably positioned within the inner rotor, the inside dimension of the outer rotor being greater than the exterior dimension of the inner rotor so that there is a chamber between the inner rotor and outer rotor and there is relative transverse movement between the inner rotor and the outer rotor during rotation thereof, the inner rotor having an axially extending slot within which the vane is slidably positioned, the slot being in communication with the first passage and the second passage, and in which a barrier is positioned within the slot to prevent fluid flow within the slot.

3. The fluid pump of claim 2 which includes valve means positioned to control fluid flow through the second passage.

4. A fluid pump comprising a base provided with a pair of spaced-apart pedestals, a pair of tubular shafts rotatably supported by the pedestals, there being a first tubular shaft and a second tubular shaft, each of which has a passage therethrough, an inner rotor attached to the tubular shafts and supported thereby, the inner rotor being provided with a first passage which extends from the first tubular shaft to the periphery of the inner rotor, the inner rotor being provided with a second passage which extends from the second tubular shaft to the periphery on the inner rotor, the peripheral position of the first passage being spaced from the peripheral position of the second passage, an outer rotor rotatably encompassing the inner rotor and supported by the pedestals and rotable about an axis which is eccentric with the respect to the axis of rotation of the inner rotor, the inner rotor having a smaller dimension than the inside diameter of the outer rotor so that a chamber is formed between the inner rotor and the outer rotor, the inner rotor having a slot therein extending substantially the length thereof, the peripheral position of the slot being between the peripheral positions of the first passage and the second passage, a vane extending substantially the length of the inner rotor and attached to the outer rotor and slidably positioned within the slot of the inner rotor, fluid flowing into the inner rotor through the first tubular shaft and through the first passage and into the chamber between the inner rotor and the outer rotor, the fluid being forced from the chamber as the chamber decreases in volume as the rotors rotate, there being fluid communication between the slot of the inner rotor and the first passage and the second passage and including barrier means within the slot to prevent axial flow of fluid therewithin.

5. The fluid pump of claim 4 which includes a check-valve carried by the inner rotor and positioned to control flow of fluid through the second radial passage.

6. The fluid pump of claim 4 which includes a check-valve carried by the inner rotor and positioned to control flow of fluid through the second radial passage and positioned adjacent the second radial passage to control flow of fluid therethrough.

* * * * *